United States Patent [19]

Komatsubara et al.

[11] Patent Number: 4,718,948

[45] Date of Patent: Jan. 12, 1988

[54] ROLLED ALUMINUM ALLOY SHEETS FOR FORMING AND METHOD FOR MAKING

[75] Inventors: Toshio Komatsubara; Toshiki Muramatsu; Mamoru Matsuo, all of Saitama, Japan

[73] Assignee: Sky Aluminium Co., Ltd., Tokyo, Japan

[21] Appl. No.: 833,376

[22] Filed: Feb. 26, 1986

[51] Int. Cl.[4] ..... C22F 1/04

[52] U.S. Cl. ..... 148/2; 148/11.5 A; 148/12.7 A; 148/417; 148/439

[58] Field of Search ..... 148/2, 11.5 A, 12.7 A, 148/417, 439

[56] References Cited

U.S. PATENT DOCUMENTS 4,589,932 5/1986 Park ..... 148/417

*Primary Examiner*—R. Dean

*Attorney, Agent, or Firm*—Wenderoth, Lind & Ponack

[57] ABSTRACT

Rolled aluminum alloy sheets having improved strength and formability are provided which are to be formed into parts for use in an application where a high strength is required after paint baking, for example, as automobile body sheets. The aluminum alloy has a composition consisting essentially of Si 1.2–2.5%, Mg 0.25–0.85%, Fe 0.05–0.4%, Cu 0.1–1.5%, and at least one of Mn 0.05–0.6%, Cr 0.05–0.3%, and Zr 0.05–0.15%, balance essentially aluminum.

10 Claims, No Drawings

ROLLED ALUMINUM ALLOY SHEETS FOR FORMING AND METHOD FOR MAKING

BACKGROUND OF THE INVENTION

This invention relates to rolled aluminum alloy sheets intended for forming and a method for making the same. More particularly, it relates to rolled aluminum alloy sheets intended for forming and suitable for use in applications requiring a high strength and paint coating by baking prior to use, for example, as automobile bodies, as well as a method for making the same.

In the prior art, most body sheets used in automobile bodies were cold rolled steel sheets. Because of the recent increasing demand for lighter weight bodies, a great attention has been drawn to rolled aluminum alloy as one of substitutes for steel. Since automobile body sheets are press formed and coated with paint by baking prior to use, a number of requirements are imposed on them, including excellent formability or workability, particularly elongation and stretchability, controlled development of Luders' marks during forming process, high strength, and maintenance of strength after paint baking.

There are known in the prior art a variety of aluminum alloy sheets for use as formed parts requiring a certain strength. They are generally classified into the following types in accordance with alloy composition.

(A) 0-tempered (fully annealed) 5052 alloy (Mg 2.2–2.8%, Cr 0.15–0.35%, balance essentially Al) and 0-tempered 5182 alloy (Mn 0.20–0.50%, Mg 4.0–5.0%, balance essentially Al) which are both non-heat-treatable Al-Mg alloys.

(B) $T_4$-tempered 2036 alloy (Cu 2.2–3.0%, Mn 0.1–0.4%, Mg 0.3–0.6%, balance essentially Al) which is a heat-treatable Al-Cu alloy.

(C) $T_4$-tempered, heat-treatable Al-Mg-Zn-Cu alloys. Exemplary of these aluminum alloys are those alloys disclosed and claimed in Japanese Patent Application Kokai Nos. 52-141409, 53-103914, and 57-98648.

(D) $T_4$-tempered 6009 alloy (Mg 0.4–0.8%, Si 0.6–1.0%, Cu 0.15–0.6%, Mn 0.2–0.8%, balance essentially Al) and 6010 alloy (Mg 0.6–1.0%, Si 0.8–1.2%, Cu 0.15–0.6%, Mn 0.2–0.8%, balance essentially Al) which are both heat treatable Al-Mg-Si alloys.

These prior art aluminum alloys, however, fail to fully satisfy all of the aforementioned requirements imposed on automobile body sheets.

More specifically, alloys (A) have insufficient strength and are susceptible to Luders' marks during forming process. The strength of alloys (A) is further reduced by paint baking. Alloys (B) have less formability and tend to lower their strength during paint baking. Alloys (C) are not fully satisfactory in formability, particularly bending properties and also tend to lower their strength during paint baking. Among alloys (D), for example, 6009 alloy has an insufficient strength and 6010 alloy is poor in elongation and bending.

Few of the conventional aluminum alloys can fully satisfy the aforementioned requirements imposed on automobile body sheets, including excellent formability, particularly elongation and stretchability, absence of Luders' marks, and high strength, particularly after paint baking.

SUMMARY OF THE INVENTION

It is, therefore, an object of the present invention to provide a rolled aluminum alloy sheet which has improved formability, particularly elongation and stretchability, is free of Luders' marks during a forming process, has a high strength, and undergoes little reduction or rather an increase in strength during paint baking after the forming process, thus ensuring the production of formed parts possessing a great strength.

Another object of the present invention is to provide a method for making such a rolled aluminum alloy sheet.

According to the present invention, there is provided a rolled aluminum alloy sheet intended for forming, consisting essentially of, on a weight basis, 1.2% to 2.5% of silicon (Si),
0.25% to 0.85% of magnesium (Mg),
0.05% to 0.4% of iron (Fe),
0.1% to 1.5% of copper (Cu), and
at least one member selected from the group consisting of 0.05% to 0.6% of manganese (Mn), 0.05% to 0.3% of chromium (Cr), and 0.05% to 0.15% of zirconium (Zr), balance essentially aluminum.

The term balance essentially aluminum means that the balance consists essentially of aluminum and concomitant impurities. By selecting the specific composition as defined above, we have succeeded in obtaining rolled aluminum alloy having improved formability and strength, and retaining the strength even after paint baking. The rolled aluminum alloy sheets are thus very useful as automobile body sheets.

The strength and formability of the alloys of the present invention are governed by the content of silicon. When strength is of particular interest, the silicon content is preferably in the range from more than 1.5% to 2.5%. When formability is of particular interest, the silicon content is preferably in the range from 1.2% to 1.5%. In the latter case, the copper content should preferably range from 0.3% to 1.5% in order to compensate for strength reduction due to the lower silicon content.

The present invention also provides a method for making a rolled aluminum alloy sheet having such improved properties. The aluminum alloy sheet is prepared by casting an aluminum alloy having a composition as defined above into an ingot, homogenizing the ingot at a temperature in the range of 450° to 560° C. for about 1 to about 48 hours, rolling the ingot into a sheet having a predetermined thickness, annealing the sheet at a temperature in the range of 500° to 570° C. for at least 5 seconds, subsequently quenching the sheet, and allowing the sheet to age at room temperature.

DETAILED DESCRIPTION OF THE INVENTION

The composition of the aluminum alloy of the present invention is limited for the following reason. All percentages are by weight unless otherwise stated. Silicon, Si Silicon is effective in imparting strength to the alloy by precipitation hardening since it forms $Mg_2Si$ with the coexisting magnesium. At the same time, silicon is effective in improving formability, particularly elongation. Silicon contents of less than 1.2% are too low to provide strength. Formability begins to lower when the silicon content exceeds 2.5%. The silicon content is thus limited to the range from 1.2% to 2.5%.

Within this range, the silicon content is preferably limited to from 1.2% to 1.5% when formability is important rather than strength. The silicon content is preferably limited to from more than 1.5% to 2.5% when strength is important rather than formability.

Magnesium, Mg

As described above, magnesium forms $Mg_2Si$ with the coexisting silicon to impart strength. Magnesium contents of less than 0.25% result in poor strength whereas elongation is detracted from at contents of more than 0.85%. The magnesium content is thus limited to the range from 0.25% to 0.85%.

Iron, Fe

Iron contributes to strength improvement by the grain refining effect. Iron contents of less than 0.05% allow grains to grow larger whereas formability is adversely affected beyond 0.4%. The iron content is thus limited to the range from 0.05% to 0.4%.

Copper, Cu

Copper serves to improve strength and formability, particularly bending properties. Copper contents of less than 0.1% are too low to be effective. Beyond the limit of 1.5%, strength is increased at the sacrifice of formability. The copper content is thus limited to the range from 0.1% to 1.5%.

When the silicon content is as low as from 1.2% to 1.5%, the copper content should preferably fall in the upper range of from 0.3% to 1.5% for the purpose of strength compensation.

Manganese (Mn), chromium (Cr), zirconium (Zr)

All these elements are effective in refining recrystallized grains, stabilizing the structure, and improving formability. No noticeable effect is obtained in these respects at a content of less than 0.05% for each of manganese, chromium, and zirconium. Formability is reduced at manganese contents of more than 0.6%. At chromium contents of more than 0.3% and/or zirconium contents of more than 0.15%, giant intermetallic compounds form to detract from elongation. The manganese content is thus limited to the range of from 0.05% to 0.6%, the chromium content to from 0.05% to 0.3%, and the zirconium content to from 0.05% to 0.15%.

The remainder of the alloy composition may be aluminum and concomitant impurities. It is known in the art that titanium (Ti) or titanium and boron (B) are optionally added in trace amounts to conventional aluminum alloys for the purpose of grain refining in cast alloys. Also, the aluminum alloy composition from which the rolled alloy sheets of the present invention are formed may contain trace amounts of Ti or Ti plus B. When titanium is added, its content preferably ranges from 0.01% to 0.15% because contents of less than 0.01 are ineffective and contents of more than 0.15% cause proeutectic $TiAl_3$ to crystallize to adversely affect formability. When boron is added along with titanium, its content preferably ranges from 1 to 500 ppm. Boron contents of less than 1 ppm is ineffective whereas coarse grains of $TiB_2$ having an adverse effect on formability grow beyond 500 ppm.

The rolled aluminum alloy sheets having the above-specified composition display improved formability including elongation, stretching or bulging and bending properties, are free of Luders' marks which might otherwise develop during forming process, and possess a high strength as will be demonstrated in the examples shown below. They undergo no reduction in strength during paint baking subsequent to the forming process and rather increase their strength during the paint baking. There are obtained paint-baked formed parts which exhibit a great strength.

The method for making the rolled aluminum alloy sheets having the above-specified composition will now be described while the reason of limitation of various parameters in a series of steps used is made clear.

At the outset, an aluminum alloy material having a composition falling within the scope of the present invention is melted and cast into an ingot in a conventional manner by any of the well-known continuous casting, semi-continuous casting and direct chill casting (DC) processes.

The ingot is subjected to a homogenizing treatment in order to refine grains into a more uniform distribution and improve formability. Heating temperatures of lower than 450° C. are too low to achieve the homogenizing effect whereas temperatures of higher than 560° C. can cause the eutectic to melt. Homogenization takes place to an insufficient extent within a heating time of shorter than about one hour. Extended heating times of longer than about 48 hours provide no additional effect, but undesirably add to the cost. Thus the homogenizing treatment is carried out at a temperature in the range of 450° C. to 560° C. for a period of about 1 to about 48 hours.

The homogenized ingot is rolled in a conventional fashion into a sheet having a predetermined thickness generally in the range from about 0.2 mm to about 4.0 mm. The rolling may be hot rolling alone or hot rolling followed by cold rolling.

The rolled sheet is subjected to an annealing or solution heat treatment and then quenched. The sheet is heated to an annealing or solid solution treatment temperature and held at the temperature for a certain time. Although no particular limit is imposed on the rate of heating up to the solution heat treatment temperature, rapid heating is preferred for further grain refinement. Thus a continuous rapid heating furnace may be used. Heating temperature for the solution heat treatment ranges from 500° C. to 570° C. because temperatures lower than 500° C. result in an insufficient solution heat treatment to accomplish the desired strength. The eutectic would melt at temperatures of higher than 570° C. Holding time at the solution heat treatment temperature should be at least about 5 seconds because the formation of solid solution is not complete within a shorter time. The preferred holding time is about 20 seconds or longer, and more preferably about one minute or longer.

The solution heat treatment is followed by quenching or hardening which may be carried out at a cooling rate equal to or higher than that of forced air cooling. The preferred cooling rate is 1000° C. per minute or higher. Water hardening is appropriate from the sole standpoint of cooling rate while forced air cooling permits for strain-free hardening.

After the solution heat treatment and hardening steps as described above, the sheet is allowed to age at room temperature in a conventional manner.

In the practical use of the thus obtained rolled aluminum alloy sheets, they are usually subjected to any desired forming processes, for example, press forming. As previously indicated, they have improved formability and generate few Luder's marks during a forming process. Only a minimized percentage of formed parts would result defective during the forming process. Formed parts are produced from rolled sheets in high yields with a good productivity. In general, a suitable paint is applied to such formed parts and baked. Depending on its type, the paint is baked at a temperature of about 150° C. to about 250° C. The strength of the formed aluminum alloy parts according to the present invention is further increased during the paint baking process as previously indicated. There are finally obtained paint-baked formed parts characterized by a remarkably high strength.

EXAMPLES

In order that those skilled in the art will better understand the practice of the present invention, the following examples are presented by way of illustration and not by way of limitation.

EXAMPLE 1

Alloy materials of the present invention having the compositions shown in Table 1 and designated as alloy Nos. 1 to 12 and comparative alloy materials having the compositions shown in Table 1 and designated as alloy Nos. 13 to 17 were melted and semi-continuously cast in a conventional well-known manner. The resulting ingots were subjected to a homogenizing treatment as shown in Table 2. Thereafter, the ingots were hot rolled into a sheet having a thickness of 4 mm, cold rolled to a thickness of 1.0 mm, and then subjected to a solution heat treatment or final annealing treatment as shown in the column "Final heat treatment" in Table 2. Thereafter, the sheets were allowed to stand for two weeks at room temperature for room temperature aging. At the end of room temperature aging, the sheets were determined for mechanical and forming properties. The results are shown in Table 3.

The aged sheets were investigated for variation in their strength before and after forming and subsequent paint baking processes. They were subjected to 5% and 10% cold working operations which correspond to an ordinary forming step. A heat treatment at 175° C. for one hour, which corresponds to a normal paint baking step, was carried out on the unworked sheets (0% cold worked sheets) and 5% and 10% cold worked sheets. The strength of the sheets was measured at each of these stages, with the results shown in Table 4.

As evident from Table 3, alloy Nos. 1 to 12 of the present invention have excellent bulging and bending properties and are free of Luders' marks, indicating improved formability. As evident from Table 4, the alloys of the present invention show an increase in strength after paint baking subsequent to forming. Apparently, there are finally obtained paint-baked formed parts having a tensile strength of 35 kg/mm$^2$ or higher.

TABLE 1

| Alloy No. | Chemical Composition of Alloys, % by weight | | | | | | | | | | |
|---|---|---|---|---|---|---|---|---|---|---|---|
| | Si | Mg | Cu | Fe | Mn | Zn | Cr | Zr | Ti | B | Remarks |
| 1 | 1.75 | 0.70 | 0.71 | 0.25 | 0.21 | — | — | — | — | — | |
| 2 | 2.05 | 0.48 | 0.58 | 0.21 | 0.20 | — | — | — | 0.02 | — | |
| 3 | 1.83 | 0.80 | 0.23 | 0.20 | 0.20 | — | — | — | 0.02 | 0.0005 | |
| 4 | 1.82 | 0.41 | 0.33 | 0.20 | 0.21 | — | — | — | 0.02 | 0.0005 | |
| 5 | 2.20 | 0.52 | 0.92 | 0.30 | 0.20 | — | — | — | 0.02 | 0.0005 | |
| 6 | 1.63 | 0.72 | 0.32 | 0.25 | — | — | 0.15 | — | 0.02 | 0.0005 | |
| 7 | 2.11 | 0.51 | 1.31 | 0.20 | — | — | — | 0.15 | 0.02 | 0.0005 | |
| 8 | 1.25 | 0.48 | 0.90 | 0.22 | 0.21 | — | — | — | — | — | |
| 9 | 1.32 | 0.63 | 0.70 | 0.20 | 0.27 | — | — | — | 0.01 | — | |
| 10 | 1.41 | 0.52 | 0.75 | 0.18 | 0.28 | — | — | — | 0.02 | 0.0003 | |
| 11 | 1.38 | 0.78 | 0.60 | 0.20 | — | — | 0.15 | — | 0.02 | 0.0002 | |
| 12 | 1.45 | 0.70 | 0.72 | 0.21 | — | — | — | 0.15 | 0.02 | 0.0002 | |
| 13 | 0.09 | 4.53 | 0.03 | 0.21 | 0.35 | — | — | — | 0.02 | 0.0003 | 5182 alloy |
| 14 | 0.30 | 0.35 | 2.31 | 0.20 | 0.24 | — | — | — | 0.02 | 0.0005 | 2036 alloy |
| 15 | 0.68 | 0.47 | 0.31 | 0.25 | 0.28 | — | — | — | 0.03 | 0.0001 | 6009 alloy |
| 16 | 0.86 | 0.85 | 0.29 | 0.20 | 0.24 | — | — | — | 0.03 | 0.0002 | 6010 alloy |
| 17 | 0.09 | 4.45 | 0.20 | 0.17 | 0.10 | 1.43 | — | — | 0.01 | 0.0002 | Al—Mg—Zn—Cu alloy |

TABLE 2

| Alloy No. | Heat Treatments | |
|---|---|---|
| | Homogenization | Final Heat Treatment |
| 1–12 | 530° C. × 10 hours | 530° C. × 1 hour + water hardening (solution heat treatment) |
| 13 | 530° C. × 10 hours | 350° C. × 2 hours + gradual cooling (full annealing, O form) |
| 14 | 530° C. × 10 hours | 500° C. × 1 hour + water hardening (solution heat treatment) |
| 15–16 | 530° C. × 10 hours | 530° C. × 1 hour + water hardening (solution heat treatment) |
| 17 | 470° C. × 10 hours | 470° C. × 1 hour + water hardening (solution heat treatment |

TABLE 3

| Alloy No. | Mechanical & Forming Properties (Example 1) | | | | | | |
|---|---|---|---|---|---|---|---|
| | PS kg/mm$^2$ | TS kg/mm$^2$ | El % | Erichsen value | LDR | Bending mm | Luders' marks |
| 1 | 18.0 | 32.5 | 29 | 9.4 | 2.14 | 0.50 | no |
| 2 | 15.8 | 30.5 | 30 | 9.5 | 2.17 | 0.50 | no |
| 3 | 16.2 | 30.8 | 29 | 9.4 | 2.18 | 0.50 | no |
| 4 | 15.1 | 29.2 | 30 | 9.5 | 2.17 | 0.50 | no |
| 5 | 18.3 | 32.1 | 28 | 9.3 | 2.17 | 0.50 | no |
| 6 | 16.8 | 31.0 | 28 | 9.3 | 2.17 | 0.50 | no |
| 7 | 19.8 | 34.1 | 28 | 9.3 | 2.17 | 0.50 | no |
| 8 | 17.3 | 31.1 | 30 | 9.4 | 2.14 | 0.50 | no |
| 9 | 18.2 | 32.0 | 29 | 9.5 | 2.15 | 0.50 | no |
| 10 | 16.5 | 29.1 | 30 | 9.5 | 2.20 | 0.50 | no |
| 11 | 18.3 | 32.5 | 29 | 9.4 | 2.17 | 0.50 | no |
| 12 | 18.6 | 33.1 | 29 | 9.3 | 2.18 | 0.50 | no |
| 13 | 14.5 | 29.8 | 28 | 9.5 | 2.19 | 0.50 | appeared |
| 14 | 18.6 | 33.3 | 25 | 8.7 | 2.11 | 1.0 | no |
| 15 | 12.7 | 23.3 | 26 | 9.5 | 2.17 | 0.50 | no |
| 16 | 16.0 | 31.3 | 27 | 9.0 | 2.17 | 0.70 | no |
| 17 | 15.9 | 31.4 | 29 | 9.3 | 2.14 | 0.50 | no |

TABLE 4

| Alloy No. | Strength before working TS | Strength before working PS | Strength after cold working 5% worked TS | Strength after cold working 5% worked PS | Strength after cold working 10% worked TS | Strength after cold working 10% worked PS | Strength after heating at 175° C. for 1 hour 0% worked TS | Strength after heating at 175° C. for 1 hour 0% worked PS | Strength after heating at 175° C. for 1 hour 5% worked TS | Strength after heating at 175° C. for 1 hour 5% worked PS | Strength after heating at 175° C. for 1 hour 10% worked TS | Strength after heating at 175° C. for 1 hour 10% worked PS |
|---|---|---|---|---|---|---|---|---|---|---|---|---|
| | Strength Variation by Equivalent Baking, kg/mm² | | | | | | | | | | | |
| 1 | 32.5 | 18.0 | 33.6 | 22.8 | 34.7 | 25.1 | 33.5 | 21.3 | 35.1 | 27.4 | 37.7 | 30.3 |
| 2 | 30.5 | 15.8 | 31.8 | 22.1 | 34.1 | 24.9 | 31.8 | 19.2 | 33.8 | 26.5 | 35.9 | 28.2 |
| 3 | 30.8 | 16.2 | 32.1 | 22.3 | 34.3 | 25.0 | 32.5 | 19.8 | 34.3 | 26.9 | 36.5 | 28.8 |
| 4 | 29.2 | 15.1 | 31.2 | 21.2 | 33.5 | 24.7 | 30.5 | 18.5 | 33.0 | 25.8 | 35.2 | 27.8 |
| 5 | 32.1 | 18.3 | 33.3 | 24.2 | 34.6 | 25.3 | 33.3 | 21.1 | 35.8 | 28.3 | 37.6 | 30.3 |
| 6 | 31.0 | 16.8 | 32.5 | 22.3 | 34.3 | 24.8 | 32.8 | 20.8 | 34.5 | 26.8 | 36.6 | 29.8 |
| 7 | 34.1 | 19.8 | 36.1 | 26.3 | 37.5 | 27.8 | 34.5 | 22.1 | 36.8 | 29.5 | 38.2 | 31.3 |
| 8 | 31.1 | 17.3 | 32.5 | 22.9 | 34.8 | 25.7 | 32.3 | 20.6 | 34.8 | 28.1 | 37.2 | 29.8 |
| 9 | 32.0 | 18.2 | 33.5 | 24.5 | 34.9 | 25.9 | 33.2 | 21.1 | 35.2 | 29.0 | 38.5 | 30.8 |
| 10 | 29.1 | 16.5 | 32.1 | 21.5 | 34.3 | 25.2 | 30.8 | 19.1 | 33.2 | 26.3 | 36.1 | 28.3 |
| 11 | 32.5 | 18.3 | 33.6 | 24.8 | 35.1 | 26.1 | 34.1 | 21.9 | 36.1 | 29.2 | 38.6 | 30.9 |
| 12 | 33.1 | 18.6 | 33.8 | 25.1 | 35.8 | 26.7 | 34.3 | 22.5 | 37.2 | 30.1 | 39.1 | 31.1 |
| 13 | 29.8 | 14.5 | 30.1 | 20.9 | 32.2 | 27.0 | 29.7 | 14.4 | 30.0 | 16.9 | 31.0 | 19.1 |
| 14 | 33.3 | 18.6 | 35.0 | 28.2 | 36.8 | 33.5 | 29.5 | 15.0 | 32.0 | 23.5 | 34.0 | 27.0 |
| 15 | 23.3 | 12.7 | 26.0 | 18.0 | 27.1 | 21.2 | 26.2 | 13.2 | 27.8 | 21.3 | 29.5 | 23.5 |
| 16 | 31.3 | 16.0 | 32.0 | 22.8 | 33.2 | 26.2 | 31.4 | 18.7 | 33.4 | 26.1 | 35.8 | 28.5 |
| 17 | 31.4 | 15.9 | 33.1 | 24.1 | 34.1 | 27.9 | 30.1 | 15.2 | 32.2 | 21.3 | 33.1 | 21.7 |

EXAMPLE 2

Cold rolled sheets having a thickness of 1.0 mm were prepared from alloy Nos. 1 to 12 of the present invention as shown in Table 1 by repeating the same procedures as in Example 1 including semi-continuous casting, homogenizing, hot rolling, and cold rolling. The cold rolled sheets were subjected to a solid solution-hardening treatment by rapidly heating them to a temperature of 540° C., holding them at the temperature for 60 seconds, and then forcedly cooled with air at a cooling rate of 1200° C./min. The sheets were then allowed to stand at room temperature for two weeks for room temperature aging. The aged sheets were determined for mechanical and forming properties, with the results shown in Table 5.

As evident from Table 5, the sheets of the present alloys exhibit improved mechanical and forming properties even when the solution heat treatment is followed by forced air cooling.

It should be noted that the mechanical properties measured are 0.2% proof stress (PS) expressed in kg/mm$_2$, tensile strength (TS) expressed in kg/mm$_2$, and percentage elongation (El) expressed in %, all measured by the standard methods. The forming properties measured include Erichsen value and limiting drawing ratio (LDR) measured by an Erichsen deep drawing test, bending given as a minimum radius by 180° bending expressed in mm, and generation of Luders' marks.

TABLE 5

| Alloy No. | PS kg/mm² | TS kg/mm² | El % | Erichsen value | LDR | Bending mm | Luders' marks |
|---|---|---|---|---|---|---|---|
| | Mechanical & Forming Properties (Example 2) | | | | | | |
| 1 | 17.6 | 31.8 | 30 | 9.6 | 2.16 | 0.50 | no |
| 2 | 15.1 | 30.0 | 29 | 9.4 | 2.14 | 0.50 | no |
| 3 | 15.3 | 29.3 | 29 | 9.5 | 2.16 | 0.50 | no |
| 4 | 14.7 | 28.9 | 30 | 9.6 | 2.17 | 0.45 | no |
| 5 | 17.9 | 31.8 | 30 | 9.4 | 2.17 | 0.50 | no |
| 6 | 15.8 | 30.3 | 29 | 9.4 | 2.17 | 0.50 | no |
| 7 | 19.2 | 33.5 | 28 | 9.4 | 2.17 | 0.50 | no |
| 8 | 17.1 | 29.8 | 30 | 9.6 | 2.15 | 0.50 | no |
| 9 | 17.9 | 31.4 | 30 | 9.6 | 2.15 | 0.50 | no |
| 10 | 16.0 | 28.5 | 31 | 9.6 | 2.18 | 0.50 | no |
| 11 | 18.0 | 31.6 | 30 | 9.5 | 2.17 | 0.50 | no |
| 12 | 18.5 | 32.1 | 29 | 9.4 | 2.18 | 0.50 | no |

As apparent from the foregoing examples, the rolled aluminum alloy sheets intended for forming according to the present invention exhibit improved formability as demonstrated by excellent bulging and bending properties and elimination of Luders' marks. They also have a sufficient strength and show an increased strength after paint baking subsequent to forming, resulting in a final paint-baked formed part having a substantially increased strength. They are thus most suitable for use as high-strength formed parts to be painted and baked on actual use, for example, automobile body sheets. Since the alloy composition for the present rolled aluminum alloy sheets contains the primary elements, Si, Mg, and Cu which are commonly used in conventional rolled sheets, extruded parts, and castings, it may be readily formulated from scraps of conventional similar alloys by making a simple modification. Reversely, scraps of the present rolled sheets may be readily recycled in the preparation of any other similar alloys or utilization in other applications. Ease of recycle of scraps leads to an additional advantage in economy.

Although the rolled aluminum alloy sheets of the present invention are best suited for use as automobile body sheets as described above, they may, of course, display favorable performance when used in other applications of high-strength formed parts, for example, automobile parts such as wheels, oil tanks, and air cleaners, various caps, cans, blinds, home appliances, meter covers, electric appliance chassis, and the like.

We claim:

1. A rolled aluminum alloy sheet intended for forming, consisting essentially of, on a weight basis, 1.25% to 2.5% of Si, 0.25% to 0.85% of Mg, 0.05% to 0.4% of Fe, 0.1% to 1.5% of Cu, and at least one member selected from the group consisting of 0.05% to 0.6% of Mn, 0.05% to 0.3% of Cr, and 0.05% to 0.15% of Zr, balance essentially aluminum.

2. A rolled aluminum alloy sheet according to claim 1 wherein the Si content is in the range from 1.25% to 1.5%.

3. A rolled aluminum alloy sheet according to claim 1 wherein the Si content is in the range from more than 1.5% to 2.5%.

4. A rolled aluminum alloy sheet according to claim 2 wherein the Cu content is in the range from 0.3% to 1.5%.

5. A rolled aluminum alloy sheet according to claim 1 which further comprises 0.01% to 0.15% of Ti.

6. A rolled aluminum alloy sheet according to claim 5 which further comprises 1 to 500 ppm of B.

7. A rolled aluminum alloy sheet intended for forming, consisting essentially of, on a weight basis, 1.25% to 1.5% of Si, 0.25% to 0.85% of Mg, 0.05% to 0.4% of Fe, 0.3% to 1.5% of Cu, and at least one member selected from the group consisting of 0.05% to 0.6% of Mn, 0.05% to 0.3% of Cr, and 0.05% to 0.15% of Zr, balance essentially aluminum.

8. A rolled aluminum alloy sheet intended for forming, consisting essentially of, on a weight basis, from more than 1.5% to 2.5% of Si, 0.25% to 0.85% of Mg, 0.05% to 0.4% of Fe, 0.1% to 1.5% of Cu, and at least one member selected from the group consisting of 0.05% to 0.6% of Mn, 0.05% to 0.3% of Cr, and 0.05% to 0.15% of Zr, balance essentially aluminum.

9. A method for making a rolled aluminum alloy sheet comprising the steps of casting an aluminum alloy consisting essentially of, on a weight basis, 1.25% to 2.5% of Si, 0.25% to 0.85% of Mg, 0.05% to 0.4% of Fe, 0.1% to 1.5% of Cu, and at least one member selected from the group consisting of 0.05% to 0.6% of Mn, 0.05% to 0.3% of Cr, and 0.05% to 0.15% of Zr, balance essentially aluminum, homogenizing the resulting ingot at a temperature in the range of 450 to 560° C. for about 1 to about 48 hours, rolling the ingot into a sheet having a predetermined thickness, annealing the sheet at a temperature in the range of to 570° C. for at least 5 seconds, subsequently quenching the sheet, and allowing the sheet to age at room temperature.

10. A method for making a rolled aluminum alloy sheet comprising the steps of casting an aluminum alloy consisting essentially of, on a weight basis, from more than 1.5% to 2.5% of Si, 0.25% to 0.85% of Mg, 0.05% to 0.4% of Fe, 0.1% to 1.5% of Cu, and at least one member selected from the group consisting of 0.05% to 0.6% of Mn, 0.05% to 0.3% of Cr, and 0.05% to 0.15% of Zr, balance essentially aluminum, homogenizing the resulting ingot at a temperature in the range of 450 to 560° C. for about 1 to about 48 hours, rolling the ingot into a sheet having a predetermined thickness, annealing the sheet at a temperature in the range of 500° to 570° C. for at least 5 seconds, subsequently quenching the sheet, and allowing the sheet to age at room temperature.

* * * * *